United States Patent [19]

Shelton

[11] Patent Number: 4,571,174

[45] Date of Patent: Feb. 18, 1986

[54] METHOD FOR DRYING PARTICULATE LAW RANK COAL IN A FLUIDIZED BED

[75] Inventor: Walter W. Shelton, Tucson, Ariz.

[73] Assignee: Atlantic Richfield Company, Los Angeles, Calif.

[21] Appl. No.: 594,967

[22] Filed: Mar. 29, 1984

[51] Int. Cl.[4] ..... F27B 15/00; F26B 7/00; C10L 5/00

[52] U.S. Cl. ..... 432/14; 44/10 J; 34/13; 432/17

[58] Field of Search ..... 432/14, 15, 16, 17; 34/13; 44/1 G, 10 J

[56] References Cited

U.S. PATENT DOCUMENTS

| | | | |
|---|---|---|---|
| 2,057,681 | 10/1936 | Harrington | 34/13 X |
| 3,980,447 | 9/1976 | Franke et al. | 44/10 J |
| 4,495,710 | 1/1985 | Ottoson | 44/10 J |

*Primary Examiner*—John J. Camby
*Attorney, Agent, or Firm*—F. Lindsey Scott

[57] ABSTRACT

An improved method for drying particulate low rank coal in a fluidized bed wherein the improvement comprises flowing hot fluidizing gas of varying temperatures upwardly through the fluidized bed so that the hottest fluidizing gas flows upwardly through the coal nearest the coal inlet and the coolest fluidizing gas flows upwardly through the coal nearest the dried coal outlet from the fluidized bed.

10 Claims, 3 Drawing Figures

METHOD FOR DRYING PARTICULATE LAW RANK COAL IN A FLUIDIZED BED

This invention relates to an improved method for drying particulate low rank coal in a fluidized bed.

In many instances, coal, as mined, contains undesirably high quantities of water for transportation and use as a fuel. This problem is common to all coals although in higher rank coals, such as anthracite and bituminous coals, the problem is less severe because the water content of the coal is normally lower and the heating value of such coals is higher. The situation is different with respect to lower rank coals, such as sub-bituminous, lignite and brown coals. Such coals, as produced, typically contain from about 20 to about 65 weight percent water. While many such coals are desirable as fuels because of their relatively low mining cost and since many such coals have a relatively low sulphur and ash content, the use of such lower rank coals as fuel has been greatly inhibited by the fact that as produced, they typically contain a relatively high percentage of water. Attempts to dry such coals for use as a fuel have been inhibited by the tendency of such coals after drying to undergo spontaneous ignition and combustion in storage, transit or the like and by the tendency of such coals during drying to ignite, particularly in the coal drying zone or immediately after discharge from the coal drying zone.

The drying required by such low rank coals is deep drying for the removal of surface water plus the large quantities of inherent water present in such low rank coals. By contrast, when higher grade coals are dried, the drying is commonly for the purpose of drying the surface water from the coal particle surfaces but not inherent water since the inherent water content of the higher rank coals is relatively low. As a result, short residence times in the drying zone are normally used and the interior portions of the coal particles are not heated since such is not necessary for surface drying. Normally, the coal leaving the dryer in such surface water drying processes is at a temperature below about 150° F. (about 65° C.) and more typically below about 110° F. (about 45° C.). By contrast, processes for the removal of inherent water require longer residence times and result in heating the interior portions of the coal particles. The coal leaving a drying process for the removal of inherent water will typically be at a temperature from about 130° to about 250° F. (about 54° to about 120° C.). When such processes for the removal of inherent water are applied to low rank coals, the coal has a tendency to ignite in the fluidized bed as a result of the contact between the high temperature gases normally used as a hot fluidizing gas to dry the coal and coal particles which have been dried to a relatively low water content.

The temperature of the hot fluidizing gas is usually limited to temperatures low enough that the coal particles in the drying zone do not ignite. Since the problem of spontaneous ignition is greatest near the discharge from the fluidized bed where the particles are driest, the temperature of the hot fluidizing gas to the entire bed is limited to the value dictated by the most readily ignited particles in the bed. In some instances, randomly distributed particles in the fluidized bed may ignite and continue to smolder during the drying process. The presence of such "glowing embers" is considered to be more frequent near the discharge from the fluidized bed since the drier, more readily ignited particles are generally found near the discharge from the fluidized bed. An earlier attempt to minimize such ignition of the dried coal particles produced in such fluidized beds involved the use of a partition placed beneath the grate or other support means to form a separate gas distribution zone beneath a portion of the fluidized bed nearest the discharge from the fluidized bed. Recycled gas from the fluidized bed was used in the separate distribution zone near the discharge to extinguish glowing embers and equalize the temperature of the particles near the discharge as disclosed in U.S. Ser. No. 519,177 entitled IMPROVED METHOD FOR STABILIZING PARTICULATE LOW RANK COAL IN A FLUIDIZED BED filed Aug. 1, 1983 by Ottoson.

According to the present invention, an improvement is accomplished in methods for drying particulate low rank coal in fluidized bed by:

(a) charging the coal to a coal drying zone;

(b) supporting the coal above the support means in the coal drying zone, the support means being adapted to the flow of a hot fluidizing gas upwardly through the support means and the coal;

(c) flowing hot fluidizing gas through the support means and the coal to fluidize the coal and dry the coal; and, (d) retaining the coal in the drying zone for a time sufficient to reduce the water content of the coal to a desired level.

The improvement comprises fluidizing the coal with hot fluidizing gas of varying temperatures, so that the hottest fluidizing gas flows upwardly through the portion of the fluidized bed nearest the coal inlet to the fluidized bed and the coolest fluidizing gas flows upwardly through the portions of the fluidized bed nearest the dried coal outlet from the fluidized bed.

In the discussion of the FIGURES, the same numbers will be used to refer to the same or similar components throughout.

In the discussion of the invention, reference will be made to "lines" to refer to conveyors, conduits and the like as commonly used to transport solid, liquid or gaseous materials as the case may be. As used in the discussion of the invention, the term "fluidized bed" is used to refer to fluidized beds, semi-fluidized beds, ebullated beds and the like. Such fluidized beds generally comprise a bed of solids which has an expanded volume greater than its settled volume as a result of the flow of gases upwardly through the bed of solids.

Figure 1:
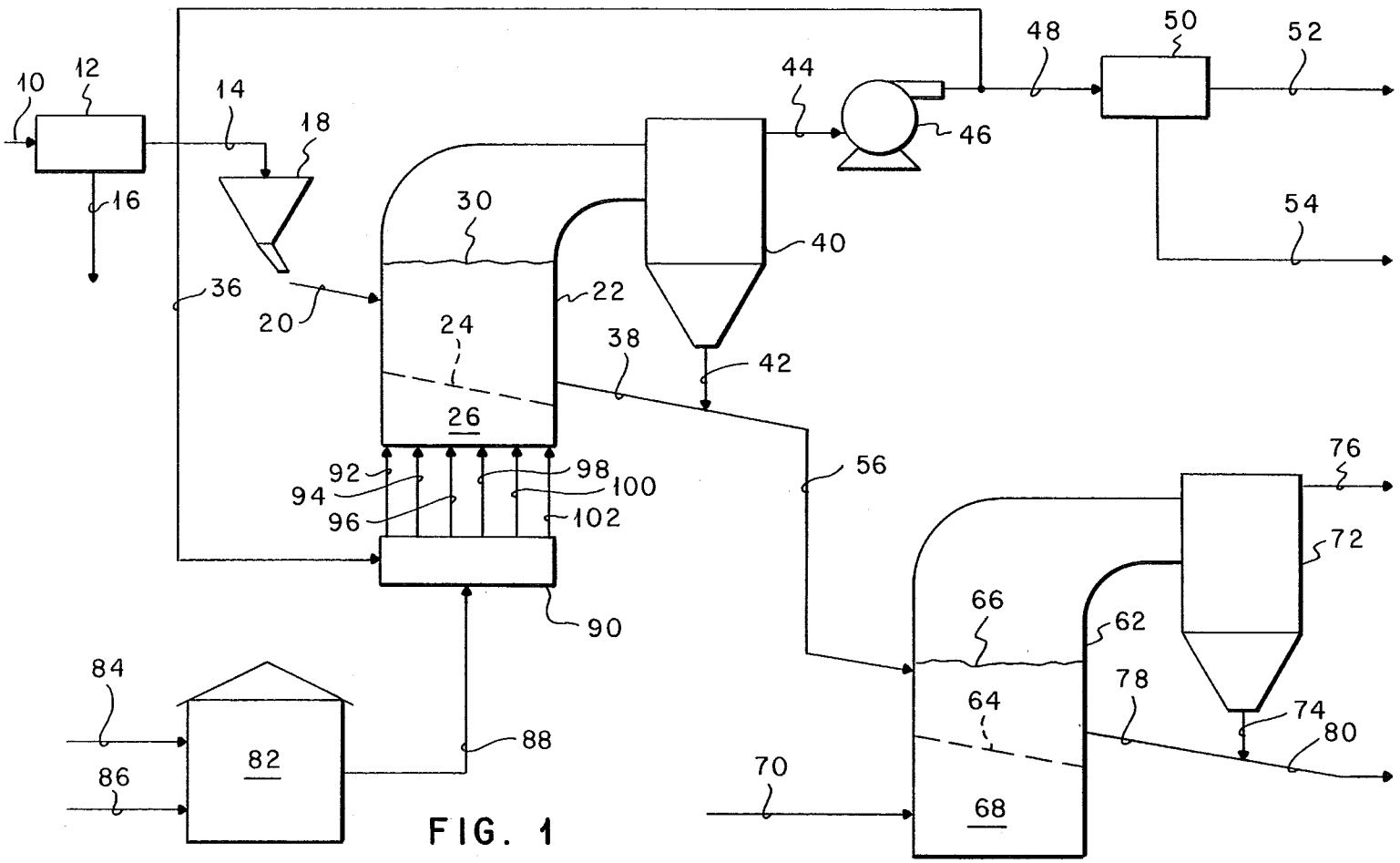
FIG. 1 is a schematic diagram of a coal drying process embodying the improvement of the present invention.

In FIG. 1, a coal drying process is shown. Coal is charged to a coal treatment zone 12 via a line 10. In coal treatment zone 12, the coal may be crushed to a desired size and inorganic materials, such as clays and gangues, may be separated from the coal and discarded through a line 16. It should be understood that in many instances coal treatment to remove inorganic materials is not required or used with low rank coals. The coal is passed from coal treatment zone 12 through a line 14 to a hopper 18 to provide a coal feed through a line 20 to a coal dryer 22. The coal charged to dryer 22 through line 20 may be of any size up to a size consist of about 2 inches by 0 although preferably the coal is of a size consist of about 1 inch by 0 and more desirably, ¾ inch by 0. Coal is charged from hopper 18 to dryer 22 via line 20 and a bed 30 of coal is maintained in dryer 22 above a support means shown as distributor 24. Distributor 24 may comprise a bar grate, a perforated plate, bubble caps, valve trays or other means known to the art for use in maintaining coal bed 30 in a fluidized condition above distributor 24. A hot fluidizing gas is charged to a distribution zone 26 beneath distributor 24. The hot fluidizing gas flows upwardly through distributor 24 at a rate suitable to fliudize the coal in bed 30. A portion of the smaller coal particles are typically entrained out of bed 30 and recovered in a gas-solids separator such as cyclone 40. The hot fluidized gas may be produced by burning a suitable fuel, such as carbonaceous liquids, coal fines or the like in a combustor 82 to produce a combustion gas (line 88) at a desired temperature. Fuel and air are supplied to combustor 82 through lines 84 and 86 respectively. The composition of the fluidizing gas stream charged to distribution zone 26 can be adjusted by various techniques such as the use of recycle or diluent streams, steam injection or the like. For instance, the composition of the fluidizing gas can be adjusted by the use of a recycle stream taken from the exhaust from dryer 22. Other streams could be used alone or in combination with such a recycle stream to adjust the composition of the fluidizing gas streams. Many such variations may be used to adjust the fluidizing gas composition to a desired range. Such a recycle stream is supplied in FIG. 1 via a line 36 from the exhaust from dryer 22.

The exhaust gas from dryer 22 flows to cyclone 40 where finely divided particulate solids are recovered through a line 42 for further processing, recombination with the dried coal recovered from dryer 22 through a line 38 or the like. The gaseous discharge from cyclone 40 is passed through a line 44, an exhaust fan 46 and a line 48 to a fine solids recovery section 50 where finely divided particulate solids in the nature of dust and the like are separated and recovered through a line 54. The finely divided solids may be passed to use as a fuel, further processing to produce larger particles of coal or the like. The cleaned gases are exhausted through a line 52 and may be passed to further clean-up and the like as required for discharge to the environment.

The dried coal streams recovered through line 38 and line 42 are passed through a line 56 to a cooler 62. In cooler 62, the coal is supported above a support member shown as a distributor 64 in a bed 66 with cooling gas being supplied through a line 70 via a distribution chamber 68 to fluidize and cool the coal in bed 66. Distributor 64 may comprise a bar grate, perforated plate, bubble caps, valve trays or other means known to the art for evenly distributing gas flow upwardly through distributor 64 and bed 66. The cooled coal from bed 66 is recovered through a line 78. The exhaust gases from cooler 62 are passed to a gas-solids separator such as a cyclone 72 from which a gaseous stream is recovered through a line 76 and passed to discharge, to further clean up prior to discharge or the like. An underflow stream is recovered from cyclone 72 through a line 74 and comprises finely divided particles which have been entrained in the exhaust stream from cooler 62. As shown in FIG. 1, the finely divided particles recovered through line 74 are blended with the particles recovered through line 78 to produce a product stream recovered through a line 80.

It will be understood that the finely divided solids recovered through lines 42, 74 and 54 can be treated in a variety of ways or used as fuel. For instance, the finely divided solids could be briquetted, pelletized or otherwise made into larger particles by a variety of means known to those skilled in the art and optionally combined with the larger coal particles. In such instances, the processed finely divided solids may not require cooling in cooler 62.

Processes such as described above are considered to be known to those skilled in the art. Two such processes are shown in U.S. Pat. No. 4,354,825 issued Oct. 19, 1982 to Fisher, et. al. and U.S. Pat. No. 4,396,394 issued Aug. 2, 1983 to Li, el al. These patents are considered to be the illustrative of processes of this type and are hereby incorporated in their entirety by reference.

In the practice of processes such as discussed above, the combustion gases produced in combustor 82 and passed to dryer 22 through line 88 are mixed with a selected quantity of recycled gas from line 36 to produce a hot fluidizing gas of a desired temperature. In such processes, the hot gases used to fluidize and dry the coal in bed 30 are typically at temperatures of about 400° to 1000° F. (about 204 to about 538° C.). Within this range, the temperature is further limited by the temperature at which the dried coal ignites in the fluidized bed. As a result, the temperature is normally controlled to a level so that the coal does not ignite. When relatively small fluidized beds are used, relatively complete mixing across the bed may be obtained. In such beds, the maximum temperature at which the fluidizing gas can be passed upwardly through the fluidized bed may be nearly the same over the entire area of the fluidized bed. When larger fluidized beds are used the behavior of the coal particles in the fluidized bed may approach plug flow. In other words, the tendency of the wet coal to move across the fluidized bed from inlet to discharge without backmixing is greatly increased. As a result, much higher fluidizing gas temperatures could be used with the wet coal near the inlet to the fluidized bed than with the driest coal near the outlet from the fluidized bed.

According to the present invention, such an objective is accomplished by varying the amount of recycle gas mixed with the hot fluidizing gas flowing through different portions of the fluidized bed.

Figure 2:
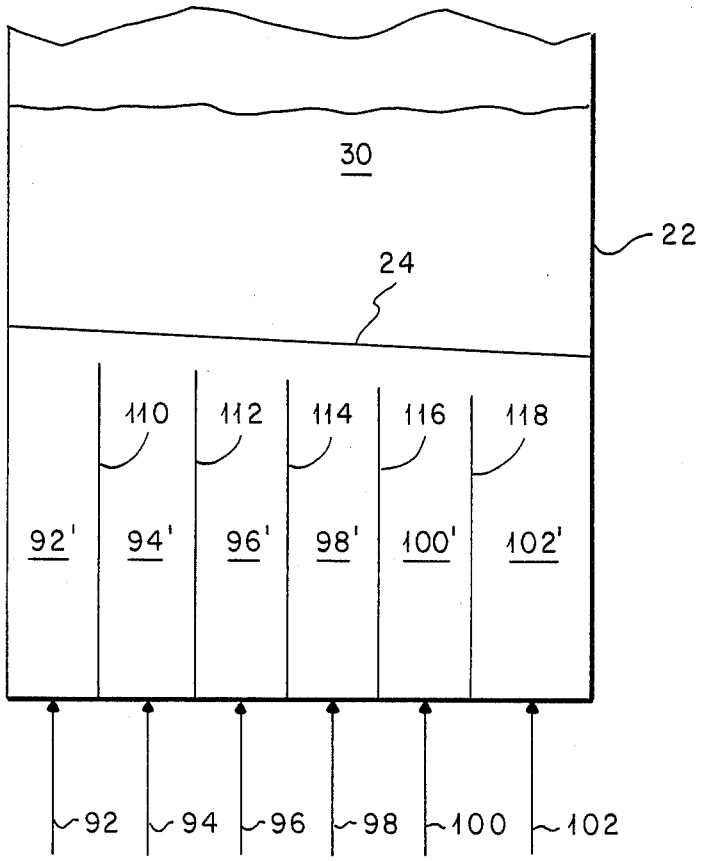
FIG. 2 is a schematic diagram of a section of a fluidized bed coal drying vessel showing a further embodiment of the present invention; and, FIG. 3 is a schematic diagram of a section of a fluidized bed coal drying vessel showing a further embodiment of the present invention.

In FIG. 1, a gas controller 90 is shown. Controller 90 comprises a plurality of valves or the like for mixing combustion gas from line 88 with recycle gas from line 36 to produce hot fluidizing gas streams in lines 92, 94, 96, 98, 100 and 102 respectively at desired temperatures. The temperature of the hot fluidizing gas steam may be quite high, i.e., up to about 1000° F. (about 538° C.) in the first portion of fluidized bed 30 near the bed inlet whereas the temperature of the hot fluidizing gas may be below about 200° F. (about 95° C.) in the portion of fluidized bed 30 near the discharge from fluidized bed 30. In FIG. 1, fluidizing gas is supplied to distribution chamber 26 through a plurality of injection lines (lines 92, 94, 96, 98, 100 and 102). The temperature of the hot fluidizing gas passed to distribution zone 26 through each of these lines can be varied and is desirably varied to provide the maximum temperature at which fluidized bed 30 may be operated above each line. In one embodiment of the present invention, the space in distribution area 26 is kept to a minimum and fluidizing gas at varying temperatures is injected and flowed upwardly through distributor 24. Desirably the flow of fluidizing gas upwardly through bed 30 is at substantially the same velocity across the width of bed 30. If substantial back-mixing or the like occurs in distribution zone 26, incomplete temperature control will be obtained. Accordingly, in some instances, it may be desirable as shown in FIG. 2 to use partitions, vanes or the like to straighten the flow through distributor area 26. In FIG. 2, a plurality of vanes shown as partial partitions 110, 112, 114, 116 and 118 which do not extend to join distributor 24 are shown to define distribution zones 92', 94', 96', 98', 100' and 102' within distribution zone 26. By the use of such vanes or the like, fluidized gas injected through lines 92, 94, 96, 98, 100 and 102 can be controlled so that the injected gas flows upwardly through fluidized bed 30 in zones generally defined by the vanes. Various other types of flow straightening devices can also be used as known to those skilled in the art.

Figure 3:
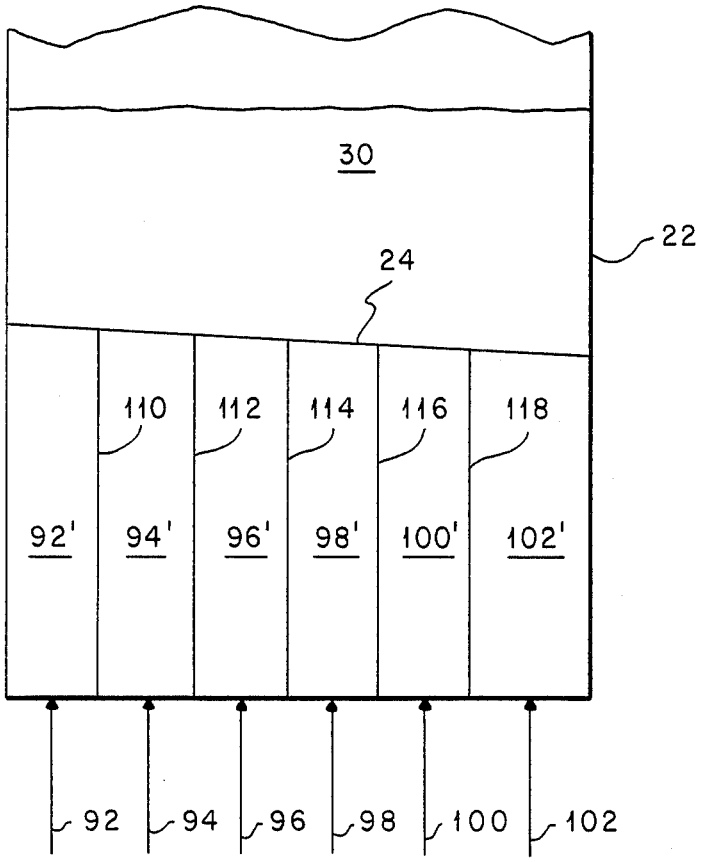

In FIG. 3, a further variation of the present invention is shown. In FIG. 3 the partitions are extended upwardly to join distributor 24 so that complete control of the fluidized gas flow is accomplished, i.e., rather than straightening gas flow the gas flow is confined to separate compartments beneath distributor 24.

The use of recycle gas to dilute the combustion gas is well known to those skilled in the art and is shown in both of the patents listed above. The recycle gas is relatively high in humidity, relatively low in oxygen and at a temperature approximating that of the exhaust gas from fluidized bed 30 less process heat losses. Such recycle gas can be combined with the combustion gas in substantially any portion to produce a fluidizing gas stream at substantially any temperature between the temperature of the recycle gas stream and the combustion gas stream. In the practice of the present invention, it is believed that the temperature of the exhaust stream will rarely exceed about 300° F. (150° C.) and will often be from about 190° to about 230° F. (about 88° to about 110° C.). Since the coal in the zones of high temperature fluidized gas will be extremely wet a substantial cooling of the fluidizing gas will occur as it passes upwardly through fluidized bed 30.

In the last distribution area 102', desirably the fluidizing gas is at a temperature less than about 300° F. (about 150° C.). This zone will usually contain the driest coal particles and it is desirable that the temperature of the dried coal particles be stablized prior to discharge from dryer 22. Accordingly, it is preferable that a high proportion or all of the fluidizing gas charged to distribution area 102' be recycle gas. The recycle gas, as mentioned previously, is relatively low in oxygen and high in humidity. As a result, little drying will be accomplished in this last zone but the temperature of the dried coal particles will tend to be equalized and any particles which may have been overheated and ignited will tend to be extinguished by the very low oxygen content of the recycle gas stream. Desirably the temperature of the fluidizing gas injected into distribution areas between first area 92' and last area 102' will be at temperatures intermediate the temperatures of the fluidizing gas in the first and last areas. Some such zones may be at substantially the same temperature in the middle portion of fluidized bed 30 dependent upon the properties of the particular coal being dried, the method of operation of the bed, the geometry of the particular fluidized bed and the like. Such variations are considered to be well known to those skilled in the art and need not be discussed in detail.

A plurality of distribution areas is used. The number of distribution areas will depend upon the size of the fluidized bed and the like. Desirably, at least three and preferably more distribution areas are used. It is particularly desirable that at least two distribution areas in addition to last area 102' be used if only recycle gas is used in last area 102'.

Having thus described the invention by reference to its preferred embodiments, it is pointed out that the embodiments described are illustrative rather than limiting in nature and that many variations and modifications are possible within the scope of the present invention. Many such variations and modifications may be considered obvious and desirable to those skilled in the art based upon a review of the foregoing description of preferred embodiments.

Having thus described the invention, I claim:

1. In a method for drying particulate low rank coal in a fluidized bed, said method consisting essentially of:

(a) charging said coal to a coal drying zone;

(b) supporting said coal above a support means in said coal drying zone, said support means being adapted to the flow of a hot fluidizing gas upwardly through said support means and said coal;

(c) flowing hot fluidizing gas through said support means and said coal to fluidize said coal and dry said coal; and, (d) retaining said coal in said drying zone for a time sufficient to reduce the water content of said coal to a desired level; an improvement comprising: flowing fluidizing gas of varying temperatures from about 200° to about 1000° F. through at least three distribution areas beneath said support means and upwardly through said fluidized bed so that the hottest fluidizing gas flows upwardly through said coal nearest the coal inlet to said fluidized bed, fluidizing gas at an intermediate temperature flows upwardly through a middle area in said fluidized bed and the coolest fluidizing gas flows upwardly through said coal nearest the dried coal outlet from said fluidized bed said coolest gas being at a temperature less than about 300° F.

2. The improvement of claim 1 wherein said hot fluidizing gas comprises combustion gas from a combustor.

3. The improvement of claim 2 wherein the temperature of said hot fluidizing gas is reduced by mixing recycled exhaust gas from said coal drying zone with said combustion gas.

4. The improvement of claim 2 wherein a plurality of hot fluidizing gas streams are passed to a plurality of gas distribution zones beneath said support means.

5. The improvement of claim 4 wherein the hottest fluidizing gas stream is passed to a first gas distribution zone nearest said coal inlet and the coolest fluidizing gas stream is passed to a final gas distribution zone nearest said dried coal outlet.

6. The improvement of claim 5 wherein the temperature of fluidizing gas streams passed to said gas distribution zones between first gas distribution zone and said final gas distribution zone are between the temperature of said hottest fluidizing gas stream and said coolest fluidizing gas stream.

7. The improvement of claim 6 wherein said fluidizing gas stream passed to said final distribution zone comprises recycled exhaust gas.

8. The improvement of claim 7 wherein said recycled exhaust gas is at a temperature below about 300° F.

9. The improvement of claim 1 wherein flow straightening means are positioned beneath said support means.

10. The improvement of claim 4 wherein said gas distribution zones are formed by partitions beneath said support means.

* * * * *